US008355649B2

(12) United States Patent
Choi et al.

(10) Patent No.: US 8,355,649 B2
(45) Date of Patent: Jan. 15, 2013

(54) DEVELOPING DEVICE AND IMAGE FORMING APPARATUS USING THE SAME

(75) Inventors: Jai Il Choi, Suwon-si (KR); Chan Su Park, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 288 days.

(21) Appl. No.: 12/923,652

(22) Filed: Sep. 30, 2010

(65) Prior Publication Data

US 2011/0085820 A1 Apr. 14, 2011

(30) Foreign Application Priority Data

Oct. 8, 2009 (KR) ..... 10-2009-0095444

(51) Int. Cl.
*G03G 15/08* (2006.01)

(52) U.S. Cl. ..... 399/106; 399/103

(58) Field of Classification Search ..... 399/103, 399/105, 106

See application file for complete search history.

(56) References Cited

U.S. PATENT DOCUMENTS

| | | | | |
|---|---|---|---|---|
| 5,446,525 | A * | 8/1995 | Kobayashi | 399/111 |
| 5,778,282 | A * | 7/1998 | Nagashima | 399/106 |
| 6,088,552 | A * | 7/2000 | Morinaga et al. | 399/106 |
| 6,118,957 | A * | 9/2000 | Fujiwara et al. | 399/103 |
| 6,118,958 | A * | 9/2000 | Nagashima | 399/105 |
| 6,289,194 | B1 * | 9/2001 | Endo et al. | 399/106 X |
| 6,834,171 | B2 * | 12/2004 | Nittani et al. | 399/103 |

* cited by examiner

*Primary Examiner* — Sandra Brase
(74) *Attorney, Agent, or Firm* — Staas & Halsey LLP

(57) ABSTRACT

Disclosed herein is a developing device. The developing device includes a housing having a toner containing unit and a developing unit, a partition member, having a toner supply window, coupled to the housing to partition the toner containing unit and the developing unit, a barrier film attached to the partition member to close the toner supply window, the barrier film having one end exposed out of the housing through a discharge port provided at a side wall of the housing, and a sheet member to guide and discharge the barrier film out of the housing.

22 Claims, 20 Drawing Sheets

DEVELOPING DEVICE AND IMAGE FORMING APPARATUS USING THE SAME

CROSS-REFERENCE TO RELATED APPLICATIONS

This application claims the benefit of Korean Patent Application No. 2009-0095444, filed on Oct. 8, 2009 in the Korean Intellectual Property Office, the disclosure of which is incorporated herein by reference.

BACKGROUND

1. Field

Embodiments of the present invention relate to a developing device and an electrophotographic image forming apparatus using the same.

2. Description of the Related Art

An electrophotographic image forming apparatus irradiates light modulated according to image information to a photosensitive body to form an electrostatic latent image at the surface of the photosensitive body, supplies toner to the electrostatic latent image to develop a visible toner image, transfers and fuses the toner image to a recording medium to print the image to the recording medium. The electrophotographic image forming apparatus includes a developing device containing toner.

A photosensitive body and toner may be provided in the form of a cartridge. This cartridge is called a 'developing device.' When toner in a developing device is completely consumed, the developing device is removed from an image forming apparatus, and a new developing device is mounted in the image forming apparatus.

A developing device may be divided into a toner containing unit and a developing unit. The toner containing unit and the developing unit are isolated from each other by a barrier film. Before the developing device is mounted in an image forming apparatus, the barrier film is removed to interconnect the toner containing unit and the developing unit.

Generally, the developing unit is also filled with a small amount of toner to perform an image test for product performance verification or for a user to perform test printing prior to purchase. The barrier film may not be easily discharged due to such toner in the developing unit.

SUMMARY

Therefore, it is an aspect of the at least one embodiment to provide a developing device in which discharge of a barrier film is not disturbed by initial toner contained in a developing unit.

Additional aspects of the at least one embodiment will be set forth in part in the description which follows and, in part, will be obvious from the description, or may be learned by practice of the invention.

The foregoing and/or other aspects are achieved by providing a developing device, including a housing having a toner containing unit to contain toner and a developing unit having a developing roller and a photosensitive drum disposed therein, a partition member, having a toner supply window, coupled to the housing to partition the toner containing unit and the developing unit, a barrier film attached to the partition member to close the toner supply window, the barrier film having one end exposed out of the housing through a discharge port provided at a side wall of the housing, and a sheet member attached to at least one of the housing and the partition member and disposed to cover a portion of the barrier film and guide the barrier film as the barrier film is discharged out of the discharge port.

The sheet member may be located adjacent to the discharge port.

The sheet member may be disposed to cover a portion of an upper part of the barrier film.

The sheet member may have a shorter length than the barrier film.

The sheet member may be fixed to the housing by a double-sided tape.

The sheet member may include a guide part disposed such that at least a portion of the guide part faces the barrier film and a coupling part, bent from the guide part, coupled to the housing and/or the partition member.

The coupling part may include a first extension, bent from the guide part in a first direction, coupled to the housing and a second extension, bent from the guide part in a second direction, coupled to the partition member.

The housing may include a coupling hole through which the first extension of the sheet member is inserted, and the first extension may include a catching part bent so as to be caught at the housing while the first extension is coupled in the coupling hole.

The second extension may be formed by partially cutting the guide part.

The partition member may include a coupling groove defined at least partially through the partition member, the second extension being fitted in the coupling groove.

The barrier film may be attached to an attachment surface of the partition member facing the developing unit.

The toner supply window may have a lower end located higher than a bottom of the developing unit.

The developing unit may have a supply roller to attach toner to the developing roller disposed therein, and the lower end of the toner supply window may be located higher than a center of the supply roller.

The discharge port may have a lower end located higher than a lower end of the toner supply window.

The lower end of the discharge port may be located higher than the lower end of the toner supply window within a range of 3 mm or less.

The developing device may further include a sealing member, made of an elastic material, coupled outside the side wall of the housing to cover the discharge port.

The sealing member may have a greater length than the discharge port.

The developing device may further include a side frame, and a push member is disposed on the side frame to push the sealing member toward the side wall.

The housing may include a lower frame constituting lower structures of the toner containing unit and the developing unit and an upper frame to cover a top of the lower frame, and the upper frame may have a tip end welded to an upper end of the partition member.

The partition member may be provided at an upper end thereof with an upper reinforcement rib extending normal in relation to an attachment surface of the partition member.

The upper reinforcement rib may include two ribs in parallel relationship.

The developing device may further include a plurality of window reinforcement ribs vertically crossing the toner supply window.

The window reinforcement ribs may be formed at positions lower than the attachment surface of the partition member in a step shape such that the barrier film is not attached to the window reinforcement ribs.

The foregoing and/or other aspects are achieved by providing an electrophotographic image forming apparatus including the above-described developing device, an optical scanning device to scan light modulated according to an image signal to the photosensitive drum, a transfer device to transfer a toner image formed on the photosensitive drum to a recording medium, and a fusing device to fuse the toner image to the recording medium using heat and pressure.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
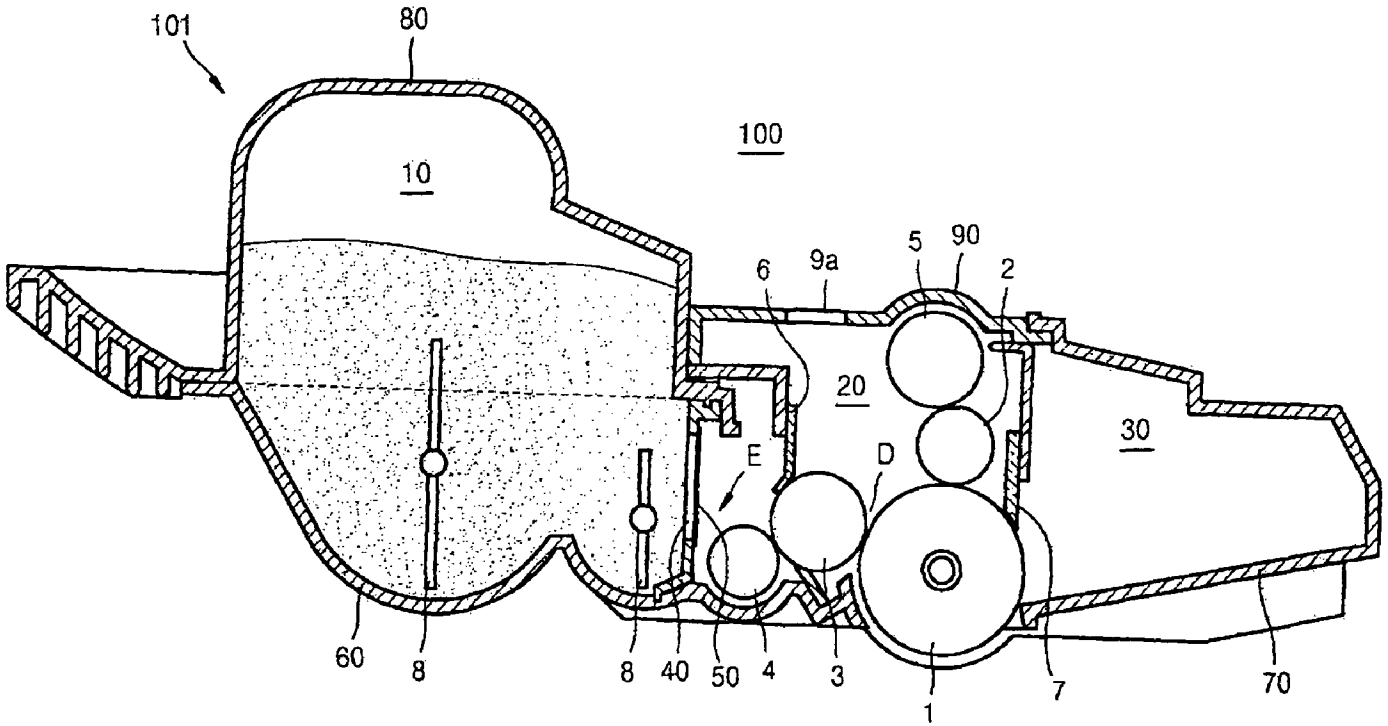
FIG. 1 is a construction view of a developing device according to at least one embodiment.

Reference will now be made in detail to the embodiments, examples of which are illustrated in the accompanying drawings, wherein like reference numerals refer to like elements throughout.

Figure 2:
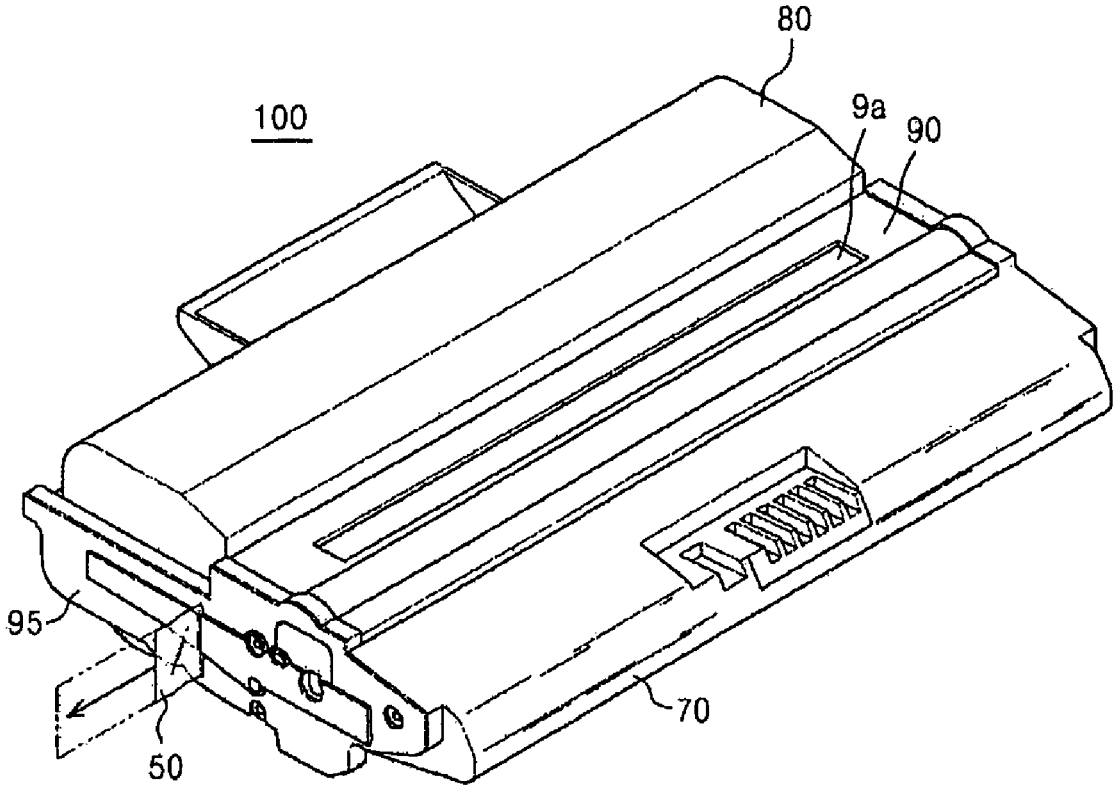
FIG. 2 is a perspective view of the developing device shown in FIG. 1.

FIG. 1 is a construction view of a developing device 100 according to at least one embodiment, and FIG. 2 is a perspective view of the developing device 100 shown in FIG. 1. Referring to FIGS. 1 and 2, the developing device 100 includes a housing 101 having a toner containing unit 10 and a developing unit 20. The housing 101 may further include a waste toner containing unit 30. Toner to be used for development is contained in the toner containing unit 10. The toner containing unit 10 and the developing unit 20 are partitioned from each other by a partition member 40. A barrier film 50 is attached to the partition member 40. When an end of the barrier film 50 exposed from one side of the developing device 100 is pulled before using the developing device 100, the barrier film 50 is separated from the partition member 40. When the barrier film 50 is removed, the toner containing unit 10 and the developing unit 20 are connected to each other, with the result that the toner contained in the toner containing unit 10 is supplied to the developing unit 20.

A photosensitive drum 1, a charge roller 2 and a developing roller 3 are disposed in the developing unit 20. The photosensitive drum 1 has an optically conductive photosensitive layer formed at the outer circumference of a cylindrical metal pipe. The charge roller 2 is an example of a charging device to charge the surface of the photosensitive drum 1 with uniform potential. A charge bias is applied to the charge roller 2. A corona charging device (not shown) may be used in place of the charge roller 2. The developing roller 3 supplies the toner, supplied from the toner containing unit 10, to an electrostatic latent image formed at the surface of the photosensitive drum 1 to develop the electrostatic latent image. In this embodiment, the developing device 100 adopts a contact development method in which the developing roller 3 and the photosensitive drum 1 contact each other to form a developing nip D. In this case, the developing roller 3 may have an elastic layer (not shown) formed at the outer circumference of a conductive metal core (not shown). When a developing bias is applied to the developing roller 3, toner moves to the electrostatic latent image formed at the surface of the photosensitive drum 1 via the developing nip D and is then attached to the electrostatic latent image. When a noncontact development method is adopted, the surface of the developing roller 3 and the surface of the photosensitive drum 1 are spaced apart from each other by hundreds of microns. A supply roller 4 to attach the toner, supplied from the toner containing unit 10, to the developing roller 3 may be further disposed in the developing unit 20. A supply bias may be applied to the supply roller 4 to attach the toner to the developing roller 3. A cleaning roller 5 to remove foreign matter and toner from the charge roller 2 is also disposed in the developing unit 20. A regulating member 6 is attached to the surface of the developing roller 3 to regulate an amount of toner to be supplied to the developing nip D. A cleaning member 7 to remove residual toner and foreign matter from the surface of the photosensitive drum 1 before charging is adjacent to the photosensitive drum 1. The residual toner and foreign matter removed from the surface of the photosensitive drum 1 by the cleaning member 7 are contained in the waste toner containing unit 30.

At least one stirrer 8 to supply toner to the developing unit 20 may be provided in the toner containing unit 10. The stirrer 8 may serve to stir the toner contained in the toner containing unit 10 to charge the toner with predetermined potential. Two stirrers 8 are shown in FIG. 1; however, the at least one embodiment is not limited thereto. An appropriate number of stirrers 8 may be provided at appropriate positions in the toner containing unit 10 to effectively supply toner to the developing unit 20 considering the capacity or shape of the toner containing unit 10.

Referring to FIGS. 1 and 2, the housing 101 of the developing device 100 may include a lower frame 60, a containing frame 70, an upper frame 80 and a cover 90. The lower frame 60 defines a lower frame of the toner containing unit 10 and the developing unit 20. The containing frame 70 defines the waste toner containing unit 30. The upper frame 80 covers the top of the toner containing unit 10. The cover 90 covers the top of the developing unit 20. The cover 90 is provided with an optical window 9*a* through which light irradiated from an optical scanning device 201 (see FIG. 14), which will be described later, is incident upon the photosensitive drum 1. A portion of the photosensitive drum 1 is exposed to the outside through an opening formed in the bottom of the developing unit 20. The lower frame 60 and the containing frame 70 may be connected to each other via a side frame 95.

Figure 3:
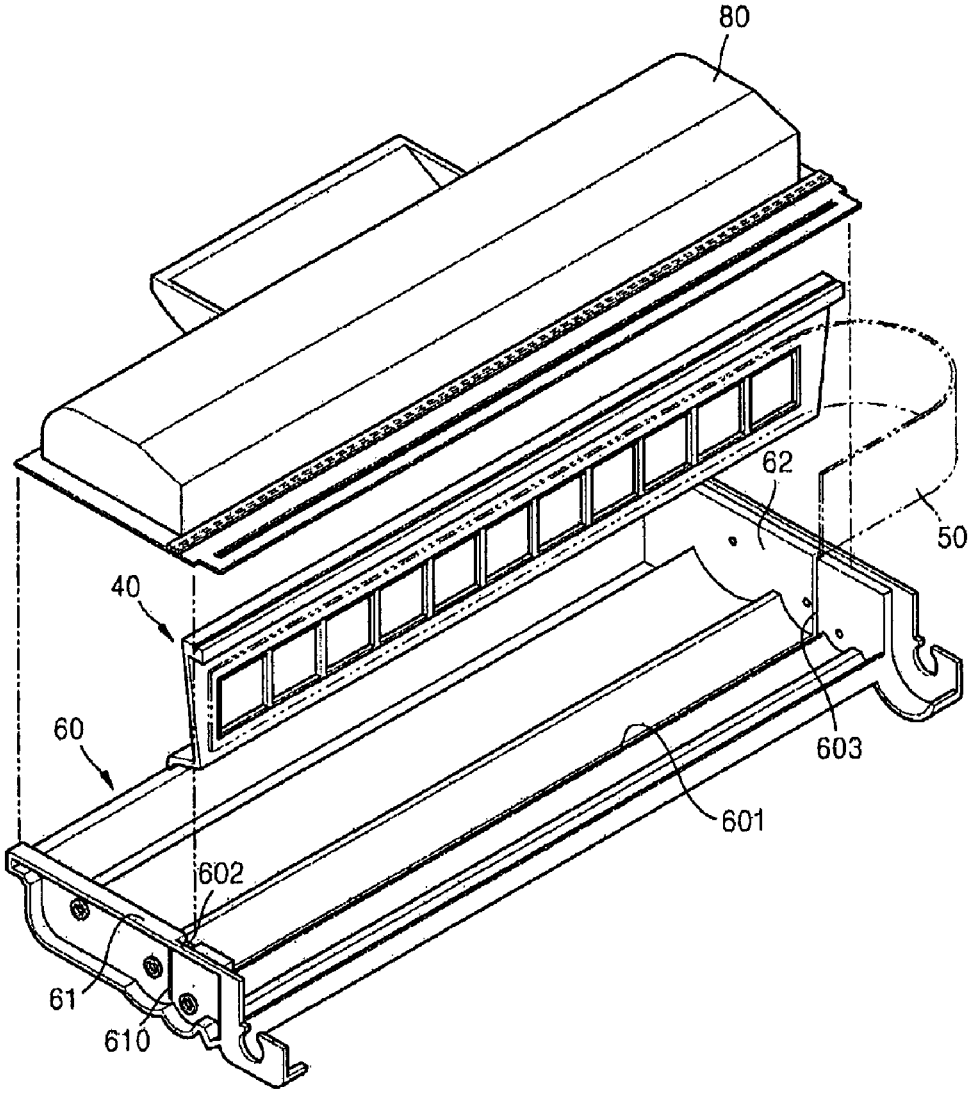
FIG. 3 is an exploded perspective view illustrating a coupling relationship among a lower frame, a partition member and an upper frame.
Figure 4:
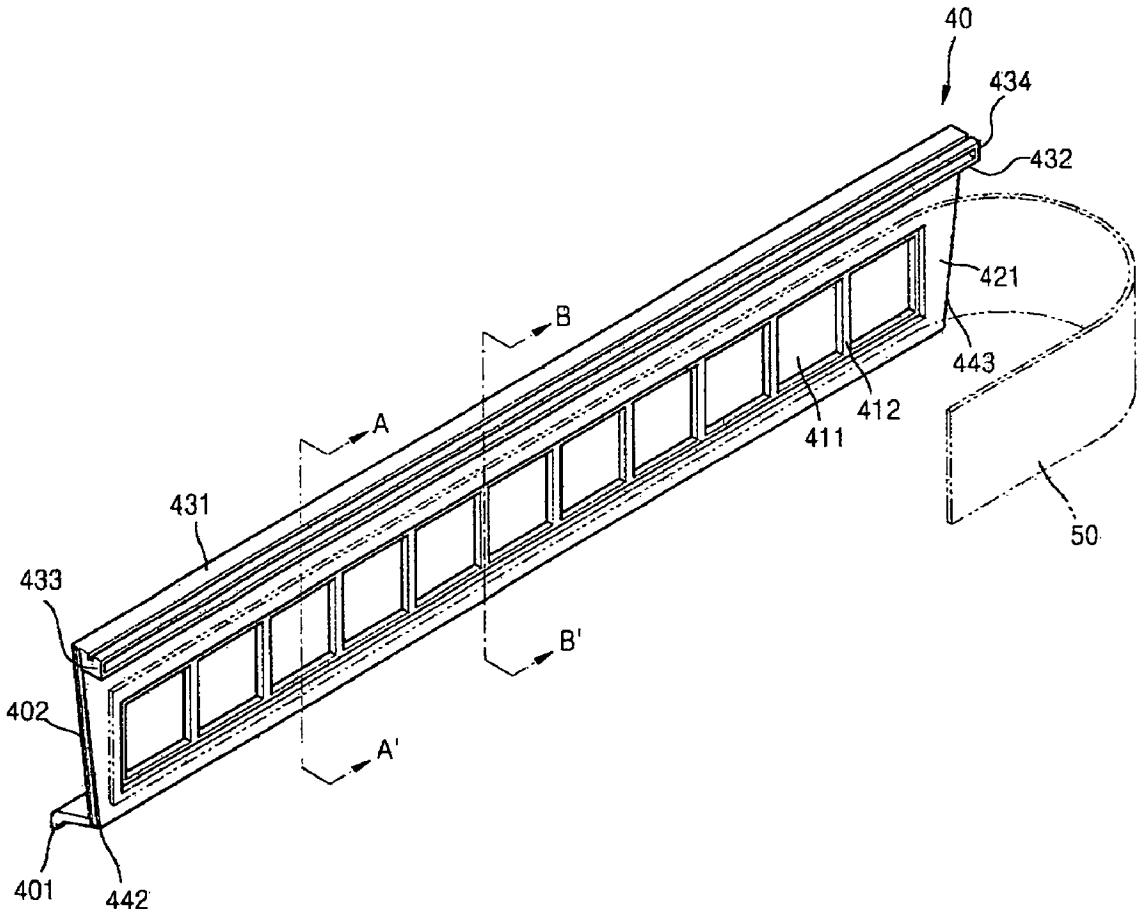
FIG. 4 is a perspective view illustrating an embodiment of the partition member.
Figure 5:
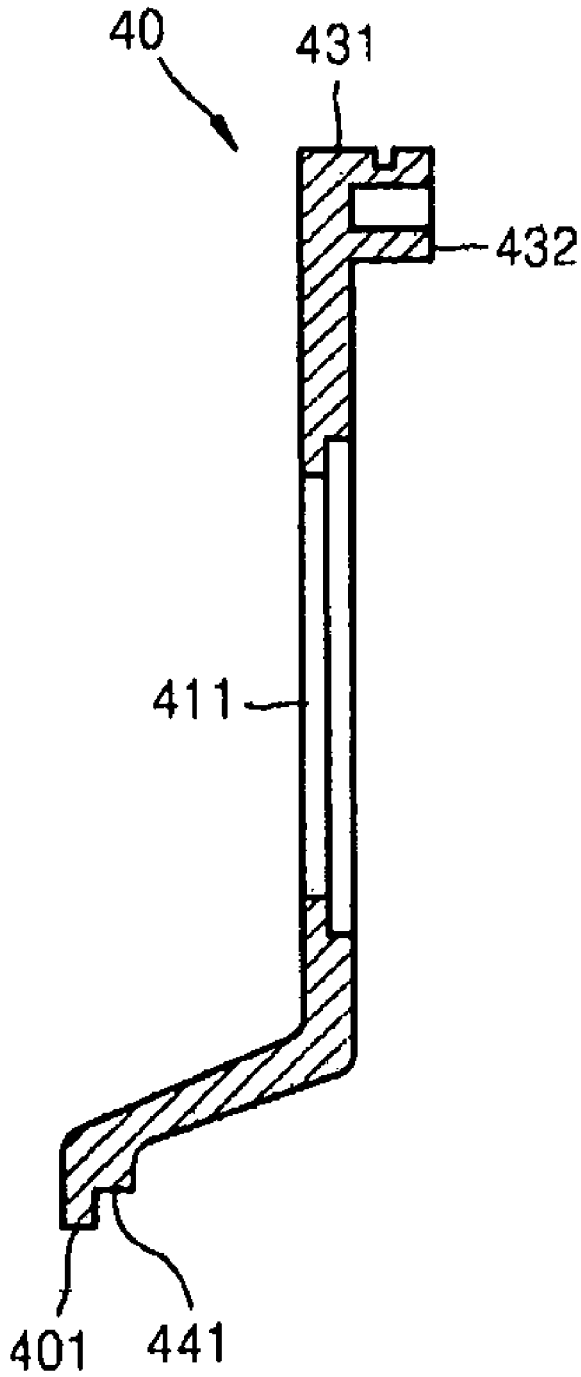
FIG. 5 is a sectional view taken along line A-A' of FIG. 4.
Figure 6:
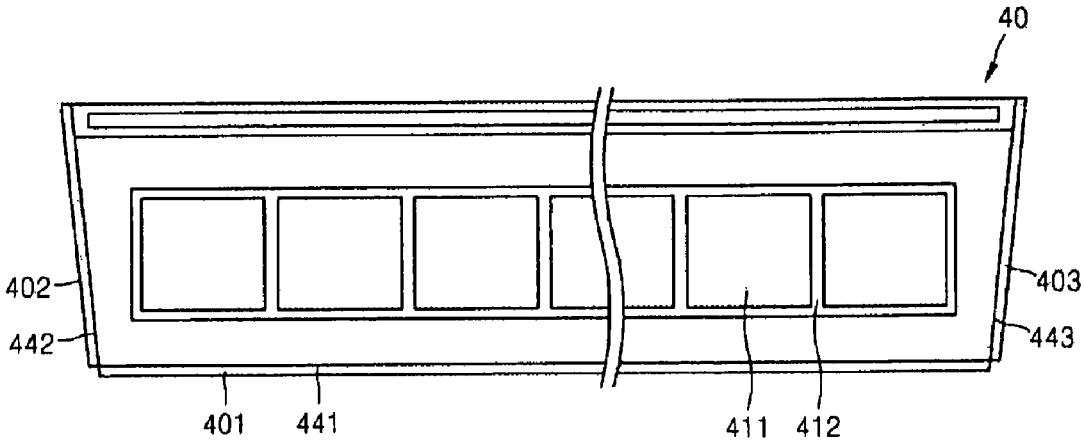
FIG. 6 is a front view of the partition member shown in FIG. 4.

FIG. 3 is an exploded perspective view illustrating a coupling relationship among the lower frame 60, the partition member 40 and the upper frame 80. FIG. 4 is a perspective view illustrating the partition member 40. FIG. 5 is a sectional view taken along line A-A' of FIG. 4. FIG. 6 is a front view of the partition member 40.

Referring to FIGS. 3 and 4, the barrier film 50 is attached to an attachment surface 421 of the partition member 40. In this state, the partition member 40 is coupled to the lower frame 60. The partition member 40 may be coupled to the lower frame 60 by ultrasonic welding, for example. To this end, as shown in FIGS. 4 to 6, a lower welding protrusion 401 is provided at a lower end 441 of the partition member 40, and side welding protrusions 402 and 403 are provided at opposite sides 442 and 443 of the partition member 40. The lower welding protrusion 401 extends in the longitudinal direction of the lower end 441. The side welding protrusions 402 and 403 extend in the longitudinal directions of the opposite sides 442 and 443 of the partition member 40. The lower frame 60 is provided with a lower welding groove 601 in which the lower welding protrusion 401 is fitted. The lower frame 60 is provided at opposite side walls 61 and 62 thereof with side welding grooves 602 and 603 in which the side welding protrusions 402 and 403 are fitted, respectively.

Figure 7:
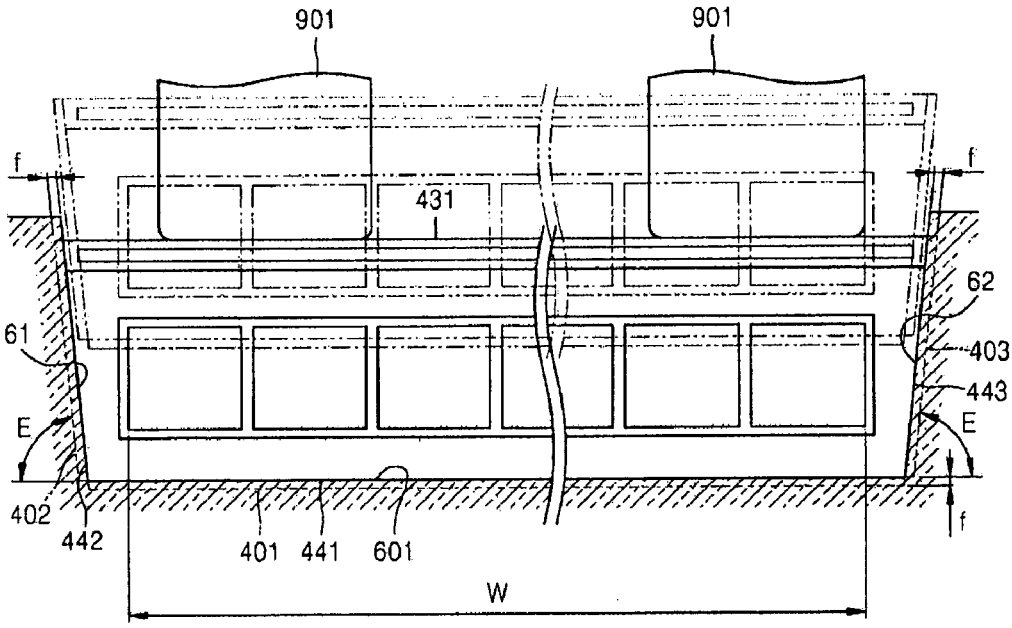
FIG. 7 is a front view illustrating a process of welding the partition wall to the lower frame.

As indicated by a dotted line in FIG. 7, the partition member 40 is placed on the lower frame 60 such that the side welding protrusions 402 and 403 are inserted into the side welding grooves 602 and 603, respectively, and ultrasonic vibration is applied to the partition member 40 while an upper end 431 of the partition member 40 is pressed by welding jigs 901. As a result, the side welding protrusions 402 and 403 are temporarily welded in the side welding grooves 602 and 603, respectively, and the partition member 40 moves downward along the side welding grooves 602 and 603. When the lower welding protrusion 401 is inserted into the lower welding groove 601, the lower welding protrusion 401 is welded in the lower welding groove 601. When the application of the ultrasonic vibration is stopped, the molten lower and side welding protrusions 401, 402 and 403 solidify and are thus attached to the lower and side welding grooves 601, 602 and 603, respectively. As a result, the partition member 40 is coupled to the lower frame 60.

At this time, an amount of overlap f between the lower and side welding protrusions 401, 402 and 403 and the lower and side welding grooves 601, 602 and 603 may be about 0.3 mm to about 0.5 mm. When the amount of overlap f is less than about 0.3 mm, the partition member 40 may not be securely welded to the lower frame 60. When the amount of overlap f is greater than about 0.5 mm, the welding protrusions 401, 402 and 403 may not be properly located in the welding grooves 601, 602 and 603, respectively.

The welding jigs 901 press the upper end 431 of the partition member 40. When the opposite sides 442 and 443 of the partition member 40 are perpendicular to the horizontal plane, pressing pressure of the welding jigs 901 does not act between the side welding protrusions 402 and 403 and the side welding grooves 602 and 603, with the result that no welding occurs. In this embodiment, the opposite sides 442 and 443 of the partition member 40 have a tilt angle E, and the opposite side walls 61 and 62 of the lower frame 60 also have the same tilt angle E. That is, the distance between the opposite sides 442 and 443 of the partition member 40 and the distance between the opposite side walls 61 and 62 of the lower frame 60 are gradually increased from the lower part to the upper part. The tilt angle E may be appropriately selected. However, when the tilt angle E is too large, i.e., almost 90 degrees with respect to the horizontal plane, the pressing pressure of the welding jigs 901 acting between the side welding protrusions 402 and 403 and the side welding grooves 602 and 603 is reduced, with the result that satisfactory welding is not achieved. According to experiments, an upper limit of the tilt angle E to achieve satisfactory welding is about 81 degrees. When the tilt angle E is decreased, the overall width of the developing device 100 may be increased to secure an effective supply width W such that toner is uniformly supplied throughout the developing unit 20. According to experiments, a lower limit of the tilt angle E to achieve welding while reducing the increase in overall width of the developing device 100 is about 75 degrees. In consideration of these concerns, the tilt angle E may be set to between about 75 degrees and about 81 degrees, although the tilt angle E is not limited thereto.

Since the opposite sides 442 and 443 of the partition member 40 and the opposite side walls 61 and 62 of the lower frame 60 have the tilt angle E as described above, welding defects between the opposite sides 442 and 443 of the partition member 40 and the opposite side walls 61 and 62 of the lower frame 60 are prevented, and the toner is prevented from leaking from the toner containing unit 10 to the developing unit 20 through spaces between the opposite sides 442 and 443 of the partition member 40 and the opposite side walls 61 and 62 of the lower frame 60.

During welding of the partition member 40 to the lower frame 60, the partition member 40 may be deformed when the welding jigs 901 press the entire upper end 431 of the partition member 40. Also, a portion of the barrier film 50 may be separated from the attachment surface 421 of the partition member 40 due to such deformation of the partition member. In consideration of such deformation and the separation possibility of the barrier film 50, the entire upper end 431 of the partition member 40 is not pressed, but portions of the partition member 40 adjacent to the opposite sides thereof are pressed, as shown in FIG. 7, in a welding process. At this time, the partition member 40 may be provided at the upper end 431 thereof with an upper reinforcement rib 432 to increase the strength of the partition member 40. As shown in FIGS. 4 and 5, the upper reinforcement rib 432 may be configured in a multi-rib structure extending in the longitudinal direction. In this embodiment, the upper reinforcement rib 432 is configured in a double-rib structure, although is not limited to such a configuration and may be, for example, a single rib structure. Also, when opposite sides 433 and 434 of the upper reinforcement rib 432 extend to the opposite sides 442 and 443 of the partition member 40, the partition member 40 may well endure the pressing pressure of the welding jigs 901.

Referring to FIG. 4, the partition member 40 is provided with a toner supply window 411 to supply the toner contained in the toner containing unit 10 to the developing unit 20. The toner supply window 411 extends in the longitudinal direction of the partition member 40 and is open. A plurality of window reinforcement ribs 412 vertically crossing the toner supply window 411 may be provided such that the toner supply window 411 is not distorted by force applied by the welding jigs 901 during welding.

Figure 8:
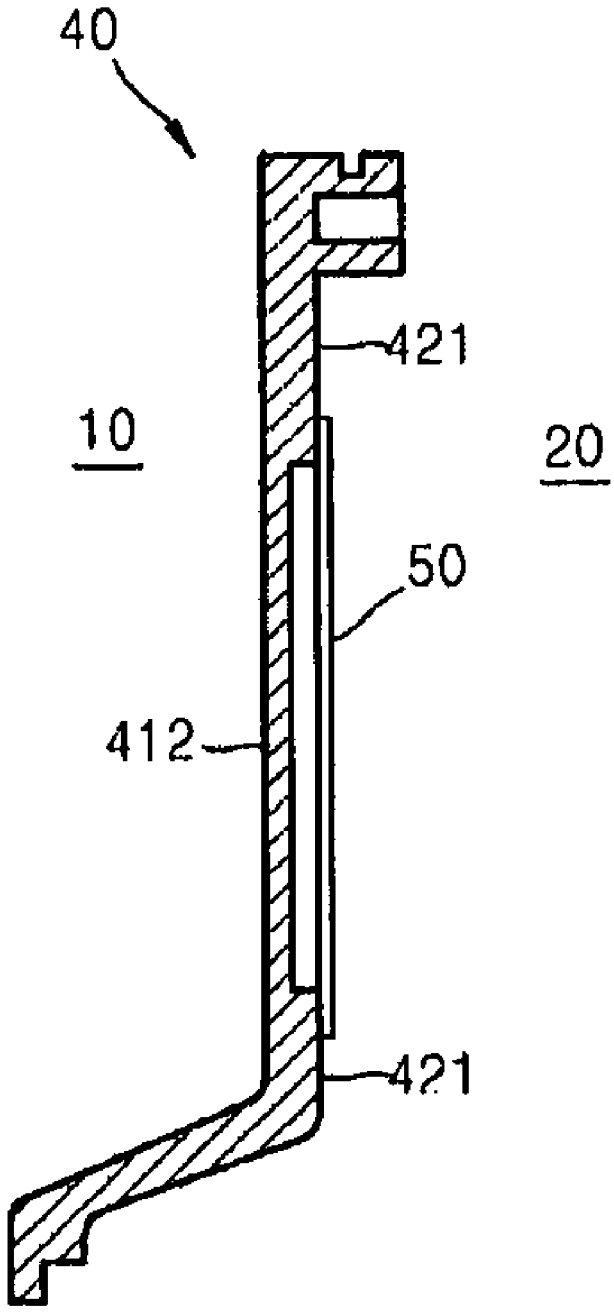
FIG. 8 is a sectional view taken along line B-B' of FIG. 4.

Referring to FIG. 8, the barrier film 50 is placed on the attachment surface 421 of the partition member 40, and heat is applied to the barrier film 50 such that the barrier film 50 is attached to the partition member 40. At this time, if the barrier film 50 is attached even to the window reinforcement ribs 412, attachment force between the barrier film 50 and the partition member 40 is large, with the result that it may be difficult to remove the barrier film 50. As shown in FIGS. 4 and 8, therefore, the window reinforcement ribs 412 are formed at positions lower than the attachment surface 421 in a step shape such that the barrier film 50 is not attached to the window reinforcement ribs 412.

Referring to FIG. 3, the lower frame 60 is provided at the side wall 61 thereof with a discharge port 610. An end of the barrier film 50 is exposed to the outside through the discharge port 610.

The toner containing unit 10 is filled with toner, and the upper frame 80 is coupled to the lower frame 60 and the partition member 40. The upper frame 80 may be coupled to the lower frame 60 and the partition member 40 by ultrasonic welding. Although not shown in the drawings, welding protrusions may be provided at the bottom of the upper frame 80, and welding grooves may be provided at the lower frame 60 and the partition member 40.

When coupling the lower frame 60 and the containing frame 70 using the side frame 95, an end of the barrier film 50 is exposed to the outside through a slit 96 (see FIG. 13) provided at the side frame 95.

Figure 9:
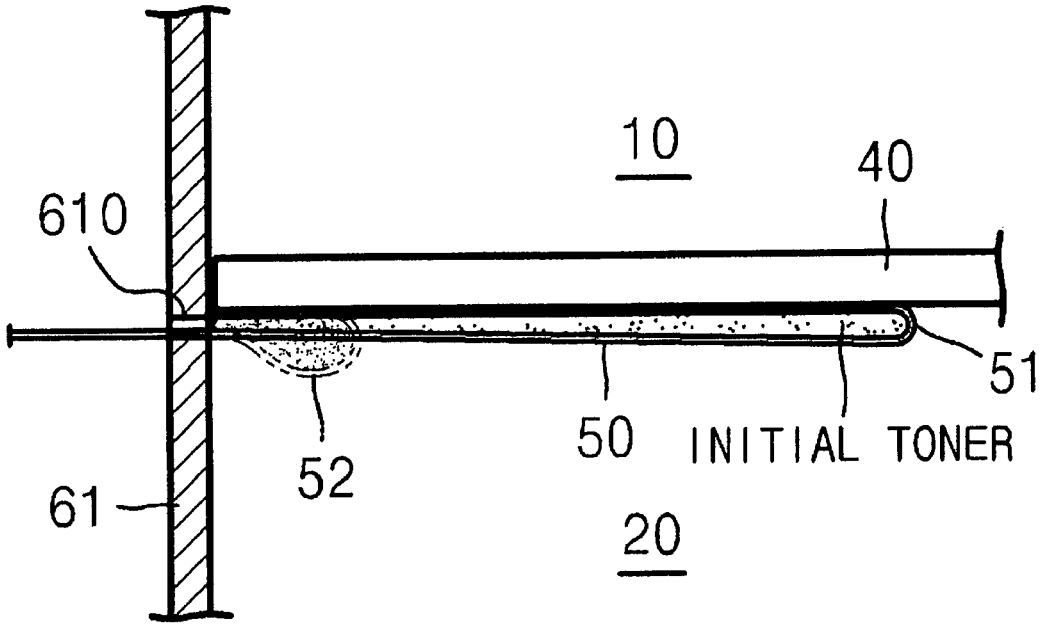
FIG. 9 is a plan view illustrating removal of a barrier film being disturbed by initial toner.
Figure 10:
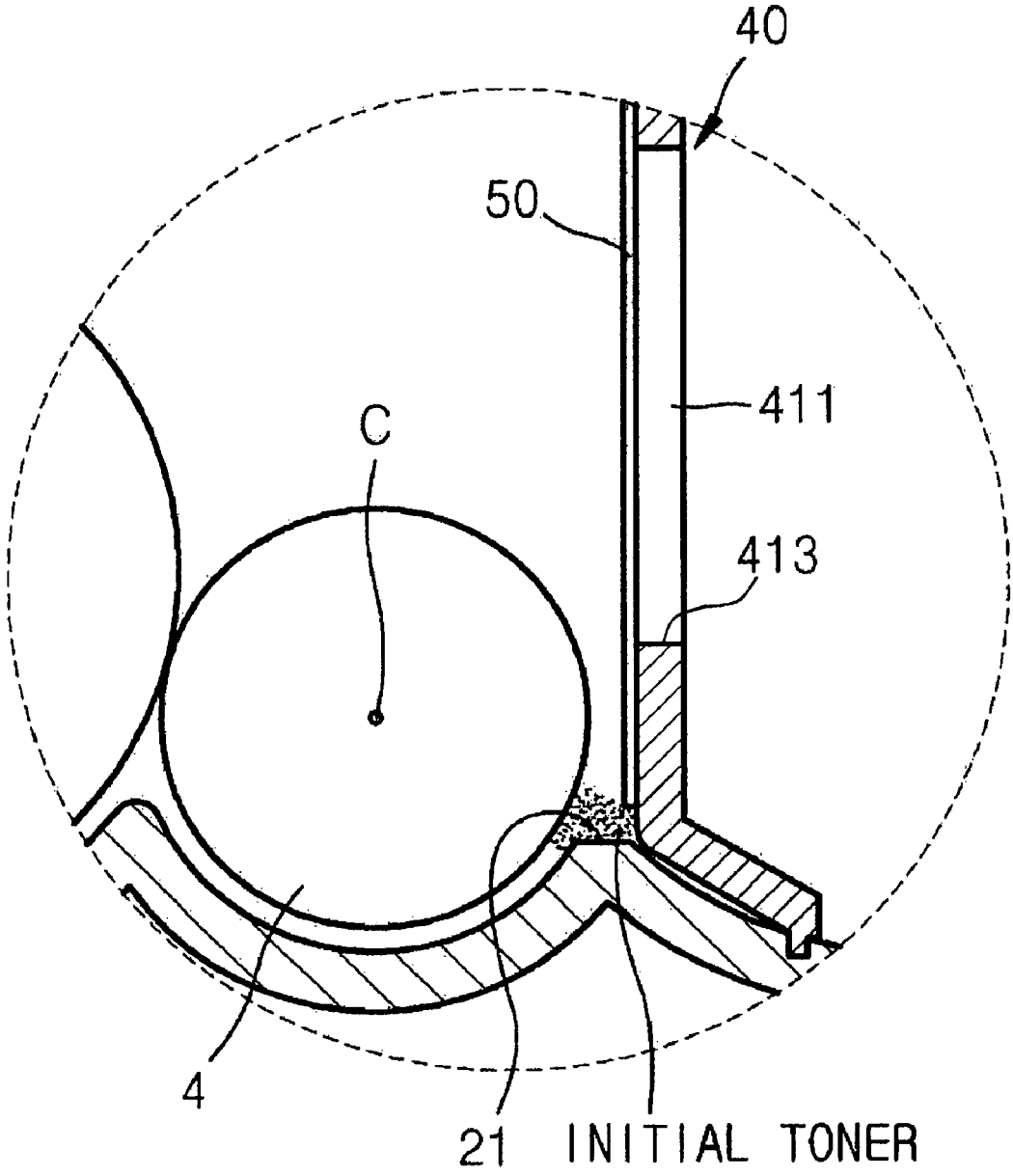
FIG. 10 is a detailed view illustrating an "E" part of FIG. 1.

FIG. 9 is a plan view illustrating discharge of the barrier film, and FIG. 10 is a detailed view illustrating an "E" part of FIG. 1. Referring to FIG. 9, the attachment surface 421, to which the barrier film 50 is attached, is a surface of the partition member 40 facing the developing unit 20. If the barrier film 50 is attached to a surface of the partition member 40 facing the toner containing unit 10, toner contained in the toner containing unit 10 is drawn toward the discharge port 610 by a bent portion 51 of the barrier film 50 during the removal of the barrier film 50, with the result that it may be difficult to discharge the barrier film 50.

A small amount of toner is contained in the developing unit 20 to perform a performance test after the manufacture of the developing device 100. If the initial toner is drawn toward the discharge port 610 by the bent portion 51 of the barrier film 50 during the discharge of the barrier film 50, the barrier film 50 is caught in the discharge port 610, with the result that it may be difficult for the barrier film 50 to pass through the discharge port 610. That is, since the toner is caught between two folded portions of the barrier film 50 as indicated by reference numeral 52 in FIG. 9, it may be difficult to discharge the barrier film 50. In consideration of this concern, as shown in FIG. 10, a lower end 413 of the toner supply window 411 is located higher than a bottom 21 of the developing unit 20. The lower end 413 of the toner supply window 411 is located higher than a center C of the supply roller 4 to reduce contact between the initial toner and the barrier film 50, with the result that, during the discharge of the barrier film 50, the amount of the initial toner drawn toward the discharge port 610 by the bent portion 51 may be reduced, and a discharge defect of the barrier film 50 due to the initial toner may be somewhat prevented.

Figure 11A:
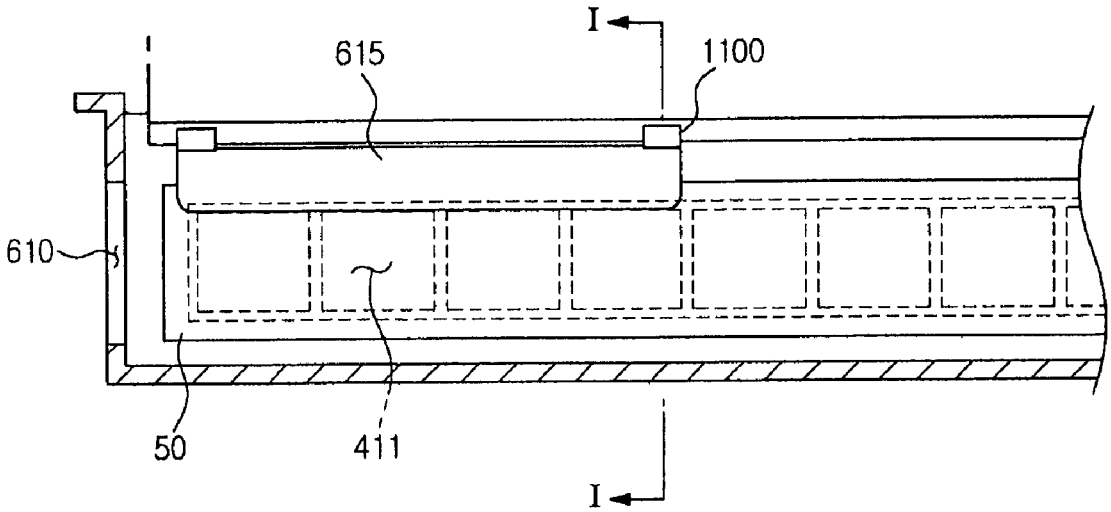
FIGS. 11A to 11D are views illustrating examples in which a sheet member is installed at the developing device according to at least one embodiment.
Figure 11B:
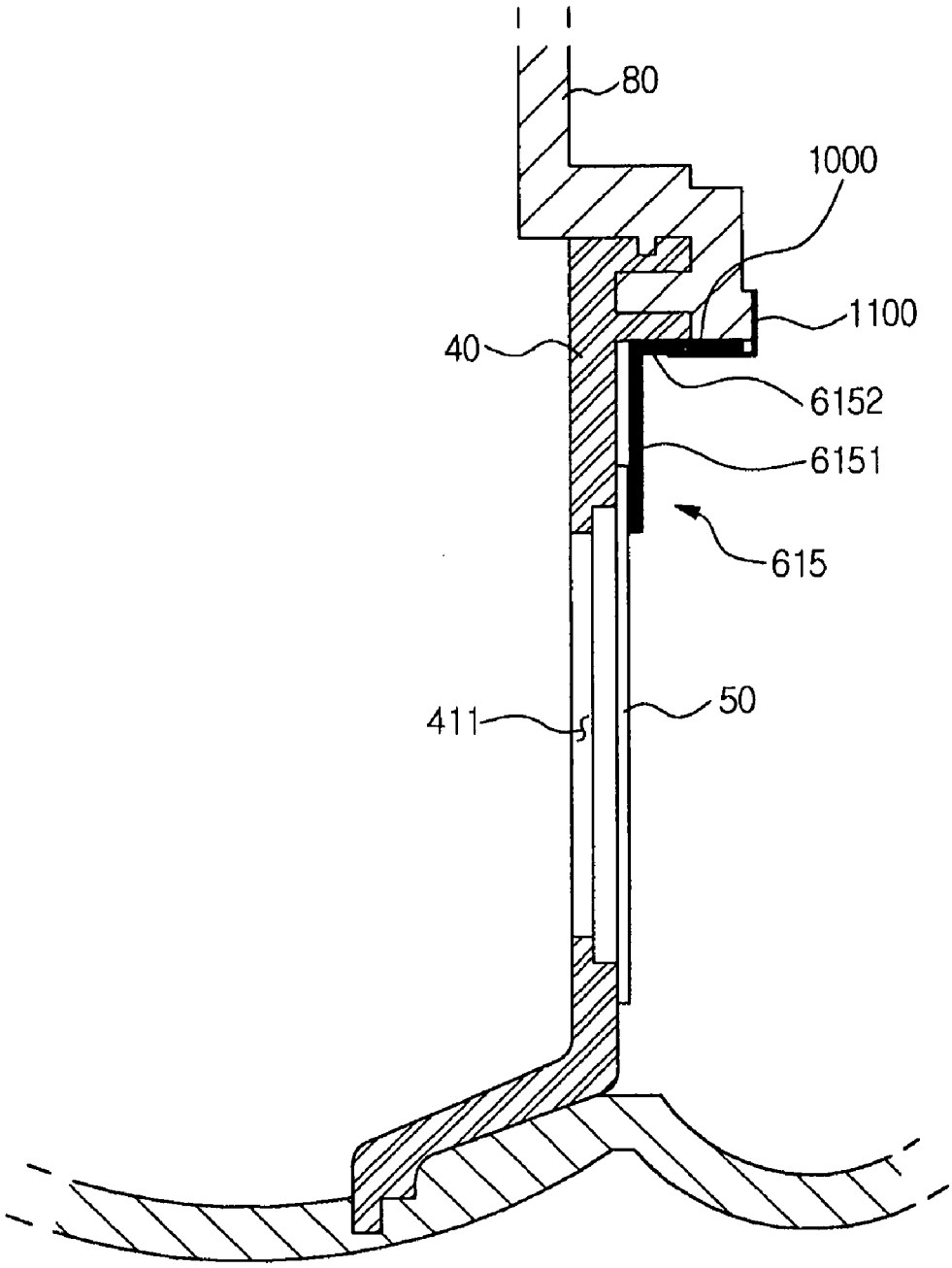
Figure 11C:
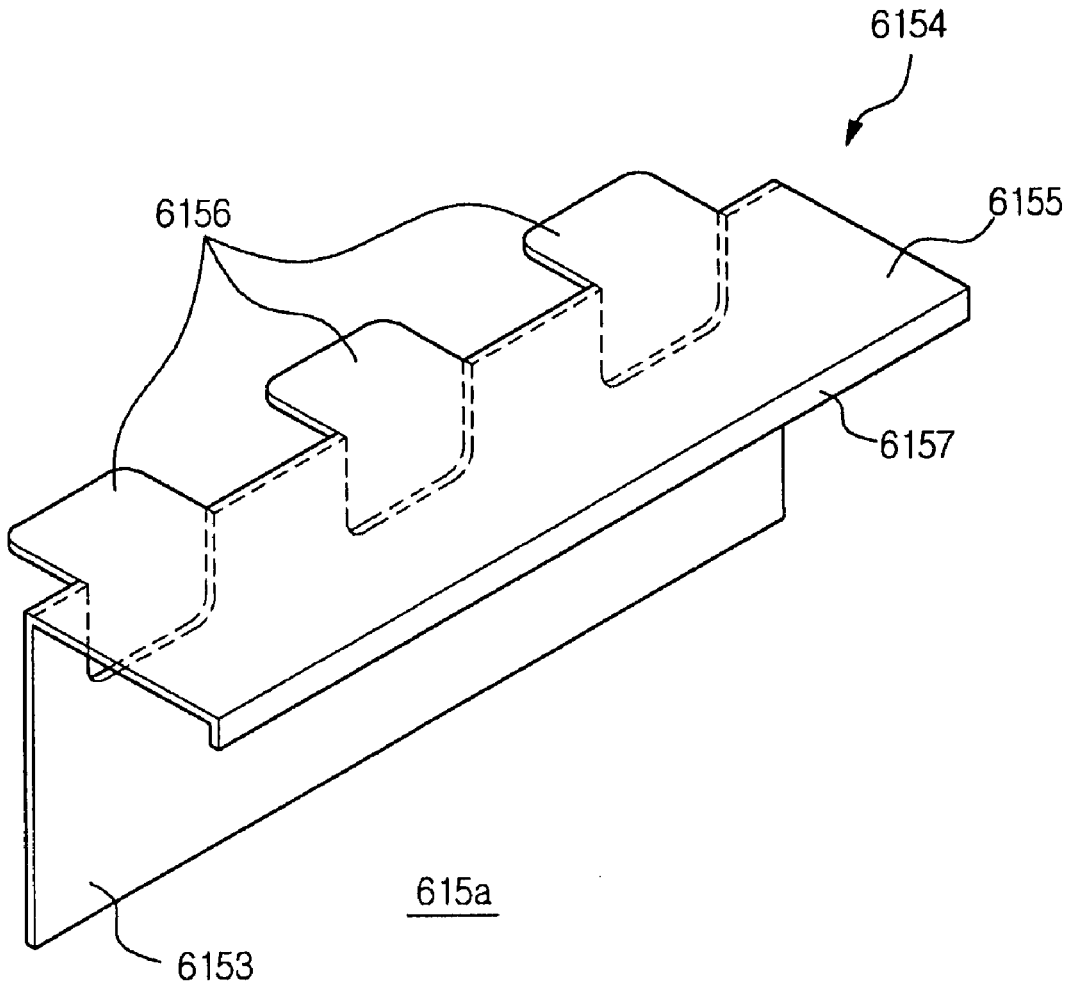
Figure 11D:
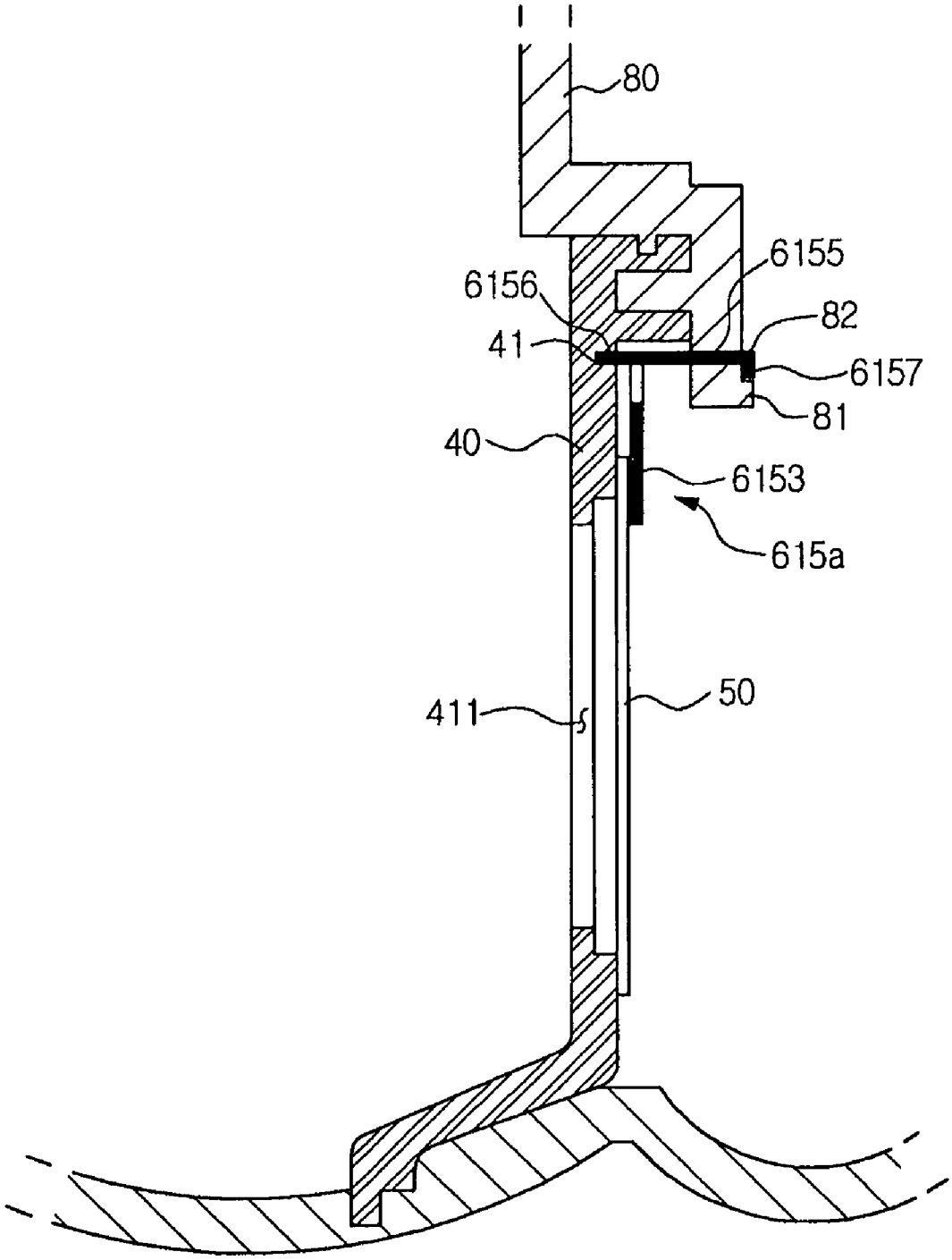

FIGS. 11A to 11D are views illustrating examples in which a sheet member is installed at the developing device according to the embodiment of the present invention. FIG. 11A is a view illustrating an example of a sheet member installation structure, and FIG. 11B is a sectional view taken along line I-I of FIG. 11A. FIG. 11C is a view illustrating another example of the sheet member, and FIG. 11D is a view illustrating the sheet member of FIG. 11C being installed at the developing device.

As shown in FIG. 11A, the developing device includes a sheet member 615 disposed to cover a portion of the barrier film 50. The sheet member 615 may be disposed adjacent to the discharge port 610 of the housing. The sheet member 615 is disposed adjacent to the discharge port 610 to guide the barrier film 50 such that the barrier film 50 is discharged while being attached to the portion where the barrier film 50 is welded to the highest degree, with the result that a discharge defect of the barrier film 50 is prevented. The sheet member 615 may be generally made of PET or PC, for example, but is not limited to such a material. The sheet member 615 may have a thickness of 0.05 mm to 0.5 mm, for example, although the thickness of the sheet member 615 is not restricted. Also, the sheet member 615 may have a shorter length than the barrier film 50. Since the sheet member 615 is provided to easily discharge the barrier film 50 from the discharge port 610, the sheet member 615 may have a sufficient length to perform functions thereof.

As shown in FIG. 11B, the sheet member 615 includes a guide part 6151 disposed to face the barrier film 50 and a coupling part 6152 bent from the guide part 6151.

The guide part 6151 is disposed such that a lower end of the guide part 6151 covers the upper part of the barrier film 50. The lower end of the guide part 6151 may be disposed not to cover the toner supply window 411 of the partition member 40.

The coupling part 6152 is bent from an upper end of the guide part 6151 such that the coupling part 6152 is attached to the partition member 40 and the upper frame 80. In at least one embodiment, a portion of the coupling part 6152 is attached to the partition member 40, and another portion of the coupling part 6152 is attached to the upper frame 80. However, the coupling part 6152 may be attached to the partition member 40 or the upper frame 80 based on the structure of the partition member 40 and the structure of the upper frame 80.

The coupling part 6152 of the sheet member 615 may be attached to the partition member 40 and the upper frame 80 via a double-sided tape 1000, for example, but is not limited thereto and may be attached by any other type of coupling method. In addition, an auxiliary tape member 1100 may also be attached to the sheet member 615 to increase a fixing strength of the sheet member 615.

As shown in FIGS. 11C and 11D, a sheet member 615*a* includes a guide part 6153 disposed to face the barrier film 50 and a coupling part 6154 to fix the sheet member 615*a* to the developing device. The coupling part 6154 may include a first extension 6155 bent from the guide part 6153 in a first direction and a second extension 6156 bent from the guide part 6153 in a second direction.

The upper frame 80 has a protrusion 81 protruding to face the sheet member 615*a*. The protrusion 81 is provided with a coupling hole 82.

The first extension 6155 of the sheet member 615*a* extends toward the protrusion 81 of the upper frame 80, and an end of the first extension 6155 is coupled to the upper frame 80 through the coupling hole 82. A catching part 6157 may be provided at the end of the first extension 6155. The catching part 6157 has a bent shape such that the first extension 6155 is caught at the housing while being coupled in the coupling hole 82.

The second extension 6156 of the sheet member 615*a* may be formed by partially cutting the guide part 6153. The second extension 6156 extends toward the partition member 40 in the direction opposite to the first extension 6155. The partition member 40 has a coupling groove 41. An end of the second extension 6156 of the sheet member 615*a* is fitted in the coupling groove 41 of the partition member 40.

As shown in FIGS. 12A to 12D, a lower end 611 of the discharge port 610 may be located higher than the lower end 413 of the toner supply window 411 of the partition member 40. In this structure, the barrier film 50 is discharged at a tilt, with the result that the initial toner is prevented from moving toward the discharge port 610 by the bent portion 51, and the film member is prevented from moving to the supply roller 4.

Consequently, some of the initial toner that is moving toward the discharge port 610 is received into a space below the lower end 611 of the discharge port 610. As a result, the discharge of the barrier film 50 is not disturbed by the initial toner.

Figure 12A:
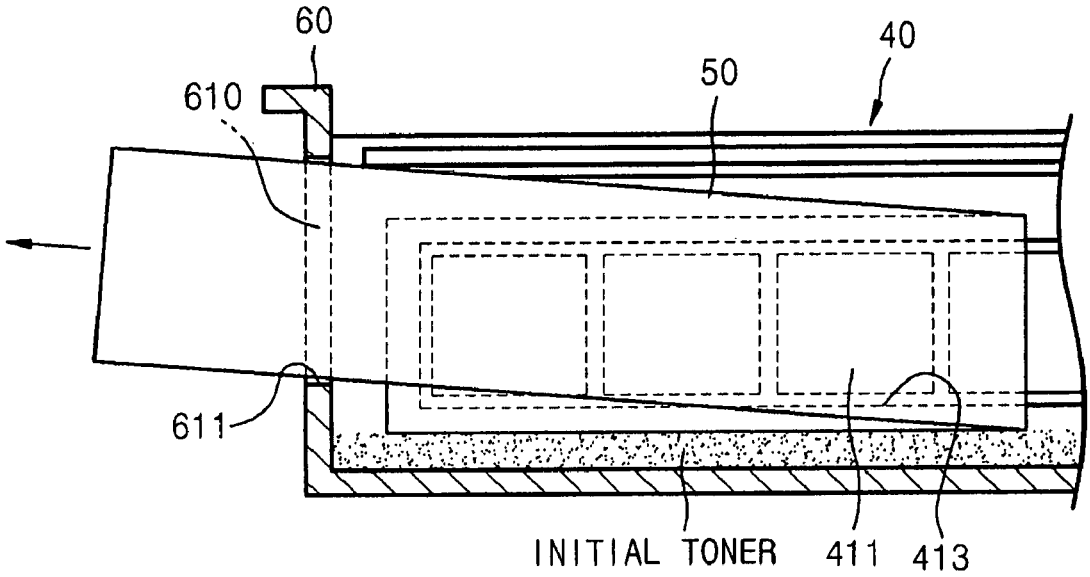
FIGS. 12A to 12D are front views illustrating positional relationships between a toner supply window and a discharge port.
Figure 12B:
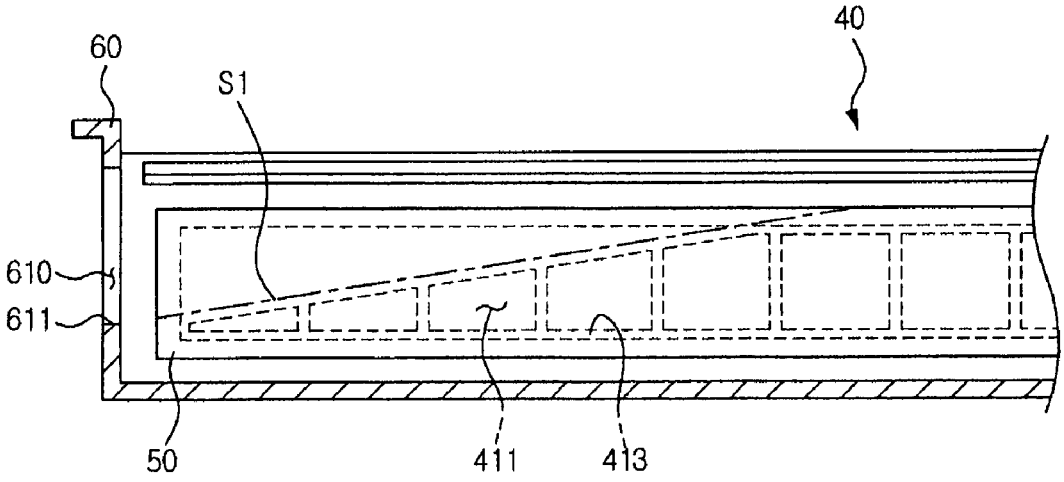
Figure 12C:
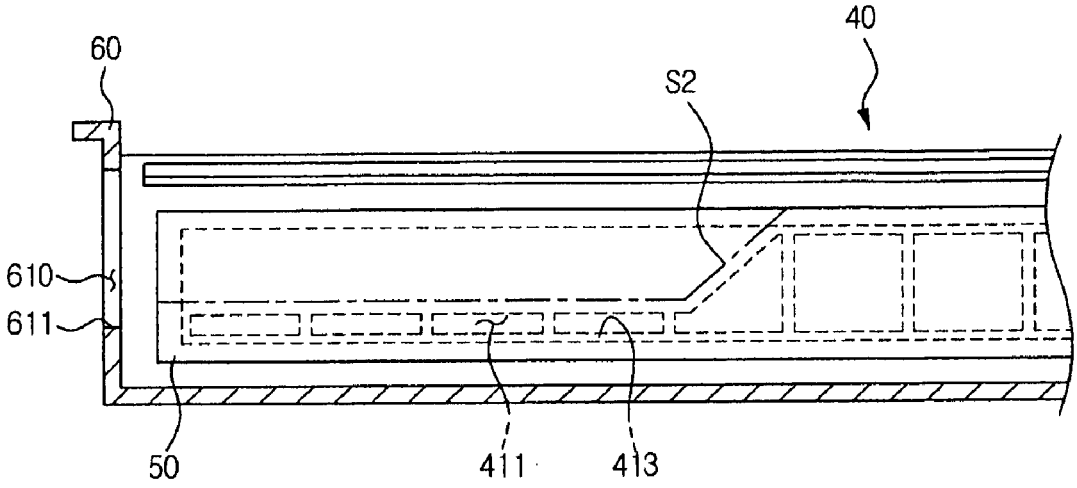
Figure 12D:
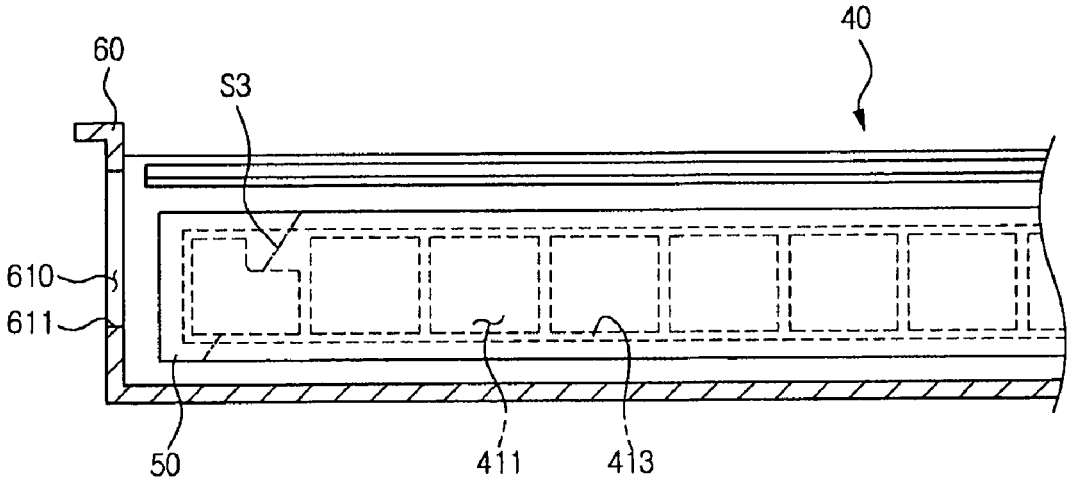

However, if the lower end 611 of the discharge port 610 is located too much higher than the lower end 413 of the toner supply window 411 of the partition member 40, a large amount of toner will be drawn at the final stage of the film discharge, with the result that a considerable amount of toner will intrude into a space between the folded portions of the barrier film 50, and therefore, the discharge of the barrier film 50 will be disturbed. For this reason, the attachment part of the film and the film discharge port 610 may be designed to deviate by less than 3 mm. When a deviation of 3 mm or more occurs, the size of the toner supply window of the partition member 40 at the discharge port side may be decreased, the barrier film 50 may be attached to the toner supply window, cutting lines S1, S2 and S3 may be formed at the barrier film 50 at a slant, and the sheet member 615 may be attached to the housing, as shown in FIGS. 12B, 12C and 12D.

Figure 13:
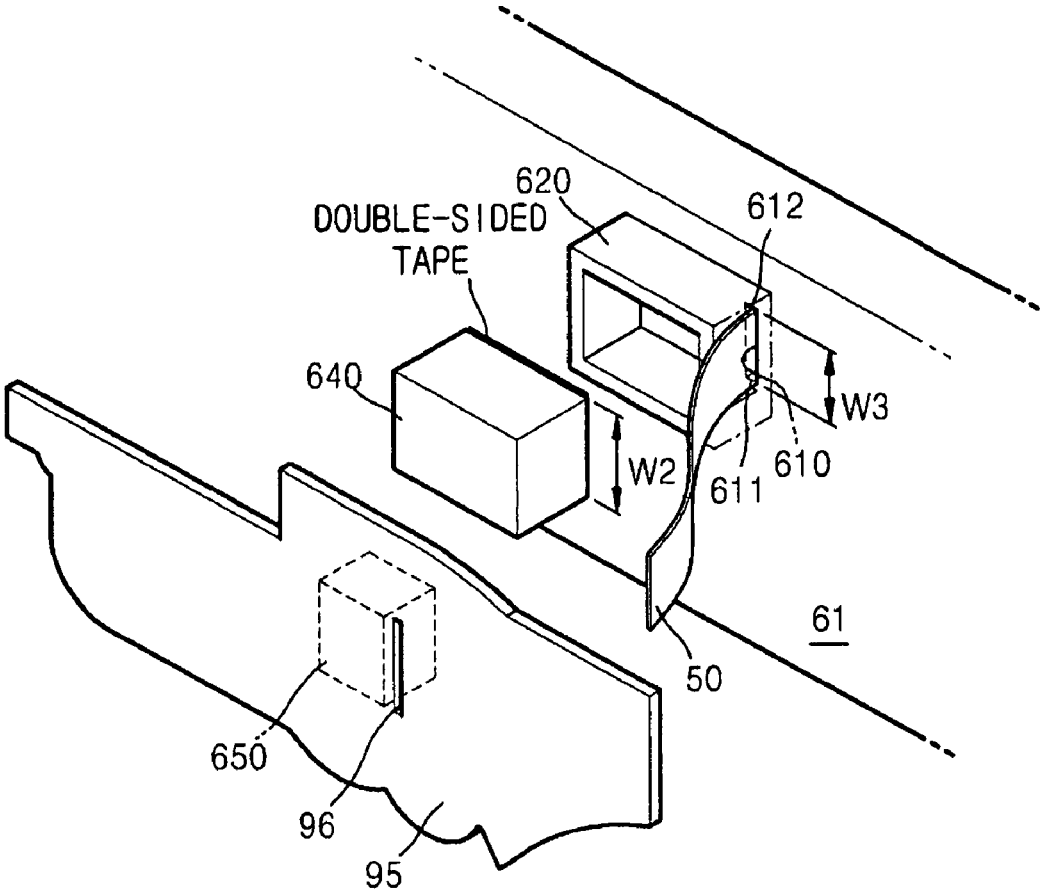
FIG. 13 is an exploded perspective view illustrating an example of a sealing member to close the discharge port.

Referring to FIG. 13, a sealing member 640 is coupled to the side wall 61 of the lower frame 60. The sealing member 640 may be attached to the side wall 61 of the lower frame 60 by a double-sided tape, for example, or by any other type of fixing method. The double-sided tape is located so as not to cover the discharge port 610. The sealing member 640 wipes off toner attached to the surface of the barrier film 50 when the barrier film 50 is discharged. The sealing member 640 has a length W2 greater than a length W3 of the discharge port 610 so as to prevent leakage of the toner when the barrier film 50 is discharged. The length W2 of the sealing member 640 is set to cover the outsides of the lower end 611 and the upper end 612 of the discharge port 610. For example, the length W2 of the sealing member 640 may be set to cover at least 0.7 mm from the lower end 611 and the upper end 612 of the discharge port 610, although the length W2 is not necessarily limited thereto. A guide rib 620 protrudes from the side wall 61 to guide a coupling position of the sealing member 640 such that the sealing member 640 is coupled to a position to cover the outsides of the lower end 611 and the upper end 612 of the discharge port 610. The sealing member 640 may be made of a foam material, such as foam rubber, exhibiting elasticity, although is not limited thereto and may be made of any type of sealing material.

Also, a push member 650 may be provided to push the sealing member 640, such that the sealing member 640 is not separated from the lower frame 60, during the removal of the barrier film 50. The push member 650 may be provided, for example, inside the side frame 954 to interconnect the lower frame 60 and the containing frame 70. When the side frame 95 is coupled to the lower frame 60 and the containing frame 70, the push member 650 pushes the sealing member 640 such that the sealing member 640 is not separated from the lower frame 60. At this time, the push member 650 may push a portion of the sealing member 640 adjacent to the discharge port 610. If the push member 650 pushes a portion of the sealing member 640 too close to the discharge port 610, the barrier film 50 is excessively pressed by the sealing member 640, with the result that the removal of the barrier film 50 may be difficult. For this reason, the push member 650 may push a position distant from the discharge port 610 by about 0.5 mm to 1 mm, although is not limited thereto.

Figure 14:
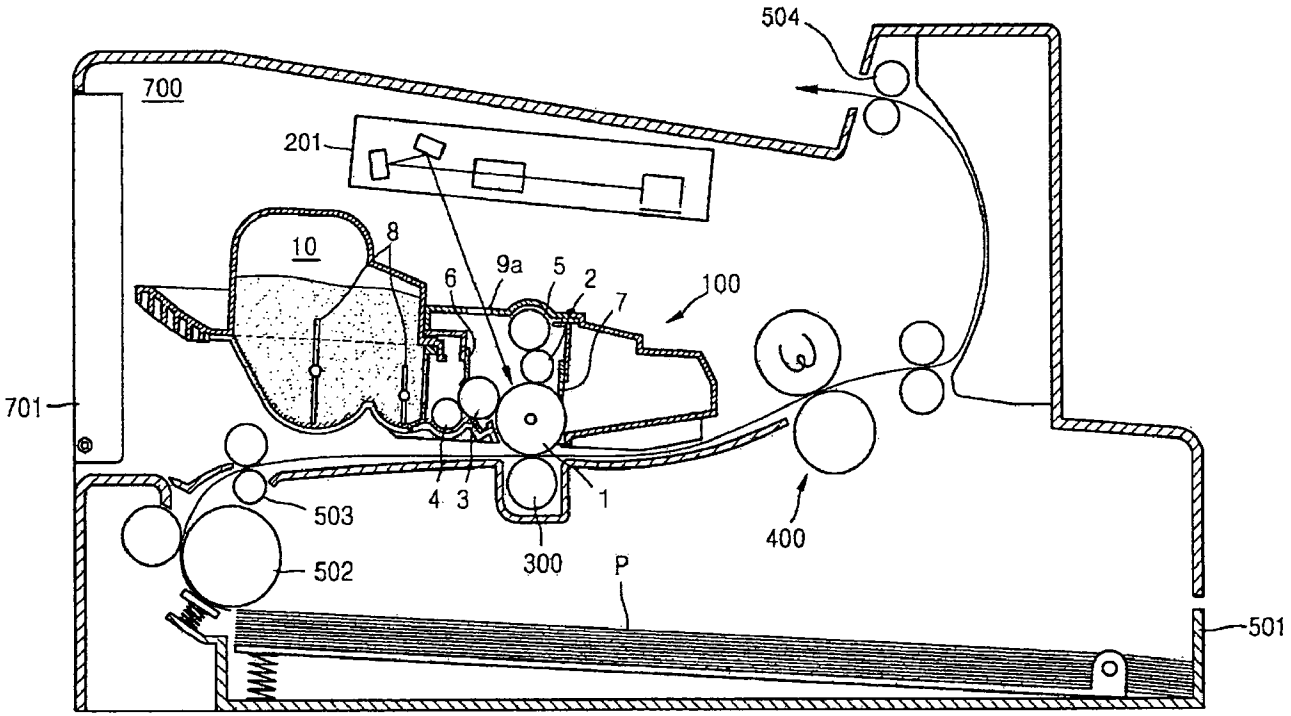
FIG. 14 is a construction view of an image forming apparatus according to at least one embodiment.

FIG. 14 illustrates an example of an image forming apparatus adopting the developing device shown in FIGS. 1 to 13. Referring to FIG. 14, the developing device 100 is mounted in an apparatus body 700 of the image forming apparatus through a door 701. Before the developing device 100 is mounted in the apparatus body 700, the barrier film 50 is removed. As a result, the toner containing unit 10 is connected to the developing unit 20 such that toner is supplied to the developing unit 20.

An optical scanning device 201 scans light modulated according to image information to the surface of the photosensitive drum 1 charged with uniform potential. For example, a laser scanning unit (LSU) that deflects light irradiated from a laser diode in a main scanning direction using a polygonal mirror and scans the deflected light to the photosensitive drum 1 may be adopted as the optical scanning device 201.

A transfer roller 300 is an example of a transfer device disposed opposite to the surface of the photosensitive drum 1 exposed through an opening to form a transfer nip. A transfer bias to transfer toner image developed on the surface of the photosensitive drum 1 to a recording medium P is applied to the transfer roller 300. A corona transfer device may be used in place of the transfer roller 300.

The toner image transferred to the surface of the recording medium P by the transfer roller 300 is maintained at the surface of the recording medium P by electrostatic attraction. A fusing device 400 fuses the toner image to the recording medium P using heat and pressure to form a permanent printed image on the recording medium P.

An image forming process based on the above construction will be described in brief. A charge bias is applied to the charge roller 2, and the photosensitive drum 1 is charged with uniform potential. The optical scanning device 201 scans light modulated according to image information to the photosensitive drum 1 through the optical window 9*a* provided at the developing device 100 to form an electrostatic latent image at the surface of the photosensitive drum 1. Toner contained in the toner containing unit 10 is supplied to the developing unit 20 by the stirrers 8 and is attached to the surface of the developing roller 3 by the supply roller 4. The regulating member 6 forms a toner layer having a uniform thickness at the surface of the developing roller 3. A developing bias is applied to the developing roller 3. With the rotation of the developing roller 3, the toner conveyed to the developing nip D moves to the electrostatic latent image formed at the surface of the photosensitive drum 1 and is attached to the electrostatic latent image by the developing bias, and a visible toner image is formed at the surface of the photosensitive drum 1. A recording medium P, withdrawn from a loading unit 501 by a pickup roller 502, is conveyed to the transfer nip using roller 503 where the transfer roller 300 and the photosensitive drum 1 face each other. When a transfer bias is applied to the transfer roller 300, the toner image is transferred to the recording medium P by electrostatic attraction. The toner image transferred to the recording medium P is fused to the recording medium P by heat and pressure applied from the fusing device 400, and therefore, printing is completed. The recording medium P is discharged by a discharge roller 504. Residual toner, which has not been transferred to the recording medium P and is present at the surface of the photosensitive drum 1, is removed by the cleaning member 7 and is contained in the waste toner containing unit 30.

As is apparent from the above description, the barrier film to prevent leakage of toner out of the developing device is easily discharged before the developing device is mounted in the image forming apparatus, thereby preventing a printed image from being blurry or defective due to poor supply of toner caused by the residual portion of the barrier film. Also, toner is prevented from leaking out of the developing device during the discharge of the barrier film.

Although at least one embodiment has been shown and described, it would be appreciated by those skilled in the art that changes may be made in these embodiments without departing from the principles and spirit of the invention, the scope of which is defined in the claims and their equivalents.

What is claimed is:

1. A developing device, comprising:

a housing including a toner containing unit to contain toner, a developing unit having a developing roller and a photosensitive drum disposed therein, the developing roller applying toner to the photosensitive drum, and a discharge port provided at a side wall of the housing;

a partition member, having a toner supply window defined therethrough, coupled to the housing to partition the toner containing unit and the developing unit;

a barrier film attached to the partition member to close the toner supply window, the barrier film having one end exposed out of the housing through the discharge port; and a sheet member attached to at least one of the housing and the partition member and disposed to cover a portion of the barrier film and guide the barrier film as the barrier film is discharged out of the discharge port.

2. The developing device according to claim 1, wherein the sheet member is located adjacent to the discharge port.

3. The developing device according to claim 1, wherein the sheet member is disposed to cover a portion of an upper part of the barrier film.

4. The developing device according to claim 1, wherein the sheet member has a shorter length than the barrier film.

5. The developing device according to claim 1, wherein the sheet member is fixed to the housing by a double-sided tape.

6. The developing device according to claim 1, wherein the sheet member comprises a guide part disposed such that at least a portion of the guide part faces the barrier film and a coupling part, bent from the guide part, coupled to at least one of the housing and the partition member.

7. The developing device according to claim 6, wherein the coupling part comprises a first extension, bent from the guide part in a first direction, coupled to the housing and a second extension, bent from the guide part in a second direction, coupled to the partition member.

8. The developing device according to claim 7, wherein the housing comprises a coupling hole through which the first extension of the sheet member is inserted, the first extension having a catching part bent to be caught at the housing while the first extension is coupled in the coupling hole.

9. The developing device according to claim 7, wherein the second extension is formed by partially cutting the guide part.

10. The developing device according to claim 7, wherein the partition member includes a coupling groove defined at least partially through the partition member, the second extension being fitted in the coupling groove.

11. The developing device according to claim 1, wherein the barrier film is attached to an attachment surface of the partition member facing the developing unit.

12. The developing device according to claim 11, further comprising a plurality of window reinforcement ribs vertically crossing the toner supply window.

13. The developing device according to claim 12, wherein the window reinforcement ribs are formed at positions lower than the attachment surface of the partition member in a step shape such that the barrier film is not attached to the window reinforcement ribs.

14. The developing device according to claim 1, wherein the toner supply window has a lower end located higher than a bottom of the developing unit.

15. The developing device according to claim 14, wherein the developing unit has a supply roller to attach toner to the developing roller disposed therein, and the lower end of the toner supply window is located higher than a center of the supply roller.

16. The developing device according to claim 1, wherein the discharge port has a lower end located higher than a lower end of the toner supply window.

17. The developing device according to claim 16, wherein the lower end of the discharge port is located higher than the lower end of the toner supply window within a range of 3 mm or less.

18. The developing device according to claim 1, further comprising a sealing member, made of an elastic material, coupled outside the side wall of the housing to cover the discharge port.

19. The developing device according to claim 18, wherein the sealing member has a greater length than a length of the discharge port.

20. The developing device according to claim 19, wherein the housing includes a side frame, and a push member is disposed on the side frame to push the sealing member toward the side wall.

21. The developing device according to claim 1, wherein the housing comprises a lower frame constituting lower structures of the toner containing unit and the developing unit, and an upper frame to cover a top of the lower frame, and the upper frame has a tip end welded to an upper end of the partition member.

22. An electrophotographic image forming apparatus, comprising:

a developing device, comprising:

a housing including a toner containing unit to contain toner, a developing unit having a developing roller and a photosensitive drum disposed therein, the developing roller applying toner to the photosensitive drum, and a discharge port provided at a side wall of the housing, a partition member, having a toner supply window defined therethrough, coupled to the housing to partition the toner containing unit and the developing unit, a barrier film attached to the partition member to close the toner supply window, the barrier film having one end exposed out of the housing through the discharge port, and a sheet member attached to at least one of the housing and the partition member and disposed to cover a portion of the barrier film and guide the barrier film as the barrier film is discharged out of the discharge port;

an optical scanning device to scan light modulated according to an image signal to the photosensitive drum;

a transfer device to transfer a toner image formed on the photosensitive drum to a recording medium; and a fusing device to fuse the toner image to the recording medium using heat and pressure.

* * * * *